US009805850B2

(12) United States Patent
Park et al.

(10) Patent No.: US 9,805,850 B2
(45) Date of Patent: Oct. 31, 2017

(54) NDFEB PERMANENT MAGNET AND METHOD FOR PRODUCING THE SAME

(71) Applicant: Hyundai Motor Company, Seoul (KR)

(72) Inventors: Kun Min Park, Gyeonggi-do (KR); Jae Ryung Lee, Gyeonggi-do (KR); Shin Gyu Kim, Incheon (KR); Hyung Ju Lee, Gyeongsangnam-do (KR)

(73) Assignee: Hyundai Motor Company, Seoul (KR)

( * ) Notice: Subject to any disclaimer, the term of this patent is extended or adjusted under 35 U.S.C. 154(b) by 407 days.

(21) Appl. No.: 14/332,792

(22) Filed: Jul. 16, 2014

(65) Prior Publication Data

US 2015/0170808 A1 Jun. 18, 2015

(30) Foreign Application Priority Data

Dec. 17, 2013 (KR) ..... 10-2013-0156969

(51) Int. Cl.

| | |
|---|---|
| ***B22F 3/24*** | (2006.01) |
| ***H01F 1/057*** | (2006.01) |
| ***H01F 41/02*** | (2006.01) |
| *B22F 3/10* | (2006.01) |

(52) U.S. Cl.

CPC ..... *H01F 1/0577* (2013.01); *H01F 41/0293* (2013.01); *B22F 3/10* (2013.01); *B22F 3/24* (2013.01); *B22F 2003/248* (2013.01); *B22F 2998/10* (2013.01); *B22F 2999/00* (2013.01); *C22C 2202/02* (2013.01)

(58) Field of Classification Search

None

See application file for complete search history.

(56) References Cited

U.S. PATENT DOCUMENTS

| | | | | |
|---|---|---|---|---|
| 5,034,146 | A * | 7/1991 | Ohashi | C22C 1/0441 148/101 |
| 5,641,363 | A * | 6/1997 | Fukuno | B22F 3/1103 148/103 |
| 2005/0133117 | A1* | 6/2005 | Tayu | H01F 1/0576 148/105 |
| 2008/0247898 | A1* | 10/2008 | Nakamura | B22F 3/24 419/9 |
| 2011/0043311 | A1* | 2/2011 | Ozeki | B22F 1/0059 335/302 |
| 2011/0205006 | A1* | 8/2011 | Odaka | C22C 33/0257 335/302 |
| 2012/0182102 | A1* | 7/2012 | Wang | H01F 1/0572 335/302 |

(Continued)

FOREIGN PATENT DOCUMENTS

| | | | |
|---|---|---|---|
| JP | 11-067510 | A | 3/1999 |
| JP | 2007-294917 | A | 11/2007 |

(Continued)

*Primary Examiner* — Jessee Roe
*Assistant Examiner* — Ngoclan T Mai
(74) *Attorney, Agent, or Firm* — Mintz Levin Cohn Ferris Glovsky and Popeo, P.C.; Peter F. Corless

(57) ABSTRACT

A NdFeB permanent magnet is provided and includes Nd of about 25 to 30 wt %, Dy of about 0.5 to 6 wt %, Tb of about 0.2 to 2 wt %, Cu of about 0.1 to 0.5 wt %, B of about 0.8 to 2 wt %, a balance of Fe and other inevitable impurities. In addition, a method for producing the permanent magnet is provided.

7 Claims, 6 Drawing Sheets

(56) References Cited

U.S. PATENT DOCUMENTS

| | | | | |
|---|---|---|---|---|
| 2012/0182105 | A1* | 7/2012 | Ozeki | H01F 41/0266 335/302 |
| 2013/0084204 | A1* | 4/2013 | Wang | B22F 1/025 419/23 |
| 2013/0266473 | A1* | 10/2013 | Wang | C22C 33/02 419/38 |
| 2015/0243433 | A1* | 8/2015 | Sun | B22F 9/04 148/102 |

FOREIGN PATENT DOCUMENTS

| | | | |
|---|---|---|---|
| JP | 2012190949 | A | 10/2012 |
| JP | 2013115156 | | 6/2013 |
| KR | 10-2006-0102480 | | 9/2006 |
| KR | 10-2008-0110450 | | 12/2008 |
| WO | 2009057592 | A1 | 5/2009 |

* cited by examiner

NDFEB PERMANENT MAGNET AND METHOD FOR PRODUCING THE SAME

CROSS-REFERENCE TO RELATED APPLICATION

This application claims under 35 U.S.C. §119(a) the benefit of Korean Patent Application No. 10-2013-0156969 filed on Dec. 17, 2013, the entire contents of which are incorporated herein by reference.

TECHNICAL FIELD

The present invention relates to a neodymium (NdFeB) permanent magnet, which costs lower and has higher performance than a conventional permanent magnet, through reducing the production cost by reducing an amount of expensive dysprosium (Dy) element and through enhancing magnetic force thereof, and a method for producing the same.

BACKGROUND

To improve fuel efficiency of a Hybrid Electronic Vehicle (HEV), a high performance magnet, which may produce higher output in a traction motor of the limited size, has been needed. In the conventional permanent magnet for a traction motor, a NdFeB sintered magnet as of a rare-earth permanent magnet has been used, but it includes expensive rare-earth elements such as Dy and Tb for higher thermal properties. Although, these elements provide higher thermal properties, they reduce magnetic force and are expensive. Accordingly, such conventional permanent magnets are not proper for the use in HEV. Therefore, it has been desired to develop a permanent magnet having higher performance with lower cost than the conventional rare-earth permanent magnet, by reducing the cost of magnet and by reducing the amount of expensive Dy element used therein and through enhancing magnetic force.

In conventional methods, for diffusing Dy or terbium (Tb), a pressed body is sintered and processed to near net shape, and subsequently a heavy rare-earth alloy or compound is coated thereon and heated for diffusion. Therefore, the process is complicated to continue. To the contrast, in the present invention, the process is reduced and more efficient than conventional process because sintering and heating processes are conducted simultaneously.

Previously, as a grain boundary diffusion technique, diffusion during sintering process has been attempted. In such a technique, grain boundary materials are coated on a pressed body, and the body is placed into a sintering furnace for a sintering process. During the sintering process, temperature is increased to 1000° C. or greater, and the vacuum atmosphere is generally of about $10^{-3}$ Pa or less. Since Dy evaporates at about 1000° C. and around $10^{-1}$ Pa, the amount of Dy wasted by evaporation is greater than the amount diffused on the magnet due to rapid evaporation in such condition.

Moreover, since Tb evaporates at about 1000° C. and around $10^{-4}$ Pa section, it does not evaporate during the sintering process. However, the diffusion efficiency of Tb is reduced since diffusion in the grain is generated due to substantially high temperature rather than diffusion to the grain boundary. Further, coating of heavy rare-earth on the pressed body may cause oxidation of the pressed body, and therefore, properties of the magnet may be deteriorated. Further, the conventional magnets were heated at argon (Ar) atmosphere after sintering, and therefore, the grain boundary diffusion materials may not evaporate or become vapor-deposited during the heating process.

The description provided above as a related art of the present invention is merely for helping in understanding the background of the present invention and should not be construed as being included in the related art known by those skilled in the art.

SUMMARY OF THE INVENTION

The present invention provides a technical solution to the above-described problems associated with related art. The present invention provides a neodymium permanent magnet (hereafter, NdFeB permanent magnet), which costs less and has higher performance than the conventional permanent magnets, through reducing the producing cost by reducing the amount of expensive Dy element and through enhancing magnetic force thereof, and a method for producing the same.

In one exemplary embodiment of the present invention, the NdFeB permanent magnet may contain neodymium (Nd) of about 25 to 30 wt %, dysprosium (Dy) of about 0.5 to 6 wt %, terbium (Tb) of about 0.2 to 2 wt %, copper (Cu) of about 0.1 to 0.5 wt %, boron (B) of about 0.8 to 2 wt %, a balance of iron (Fe) and other inevitable impurities. In addition, the sum of the Dy content and the Tb content may be of about 2 to 7 wt %. The NdFeB permanent magnet may further contain praseodymium (Pr) of about 5 wt % or less.

In another exemplary embodiments of the present invention, the method for producing the NdFeB permanent magnet may include: a grinding step of finely grinding a NdFeB stripcasted alloy consisting of the above composition of the NdFeB permanent magnet except Tb, thereby forming a NdFeB stripcasted alloy powder; a preparing step of a Tb powder separately from the composition in the grinding step; a sintering step of sintering the NdFeB stripcasted alloy powder and the Tb powder together; and a heating step for heat treating the sintered powders.

The Tb powder may consist of at least one of a metal, alloy or compound containing Tb. In the grinding step, the NdFeB stripcasted alloy may be finely ground to the size of about 3 to 6 μm. The sintering step may be conducted at about 1000 to 1100° C. for about 3 to 5 hours. The sintering step may be conducted at the vacuum condition of about $10^{-3}$ to $10^{-2}$ Pa. The heating step may be conducted at the condition of about $10^{-5}$ to $5\times10^{-5}$ Pa and about 850 to 950° C.

BRIEF DESCRIPTION OF THE DRAWINGS

The above and other features of the present invention will now be described in detail with reference to exemplary embodiments thereof illustrated the accompanying drawings which are given hereinbelow by way of illustration only, and thus are not limiting the present invention, and wherein.

Figure 1:
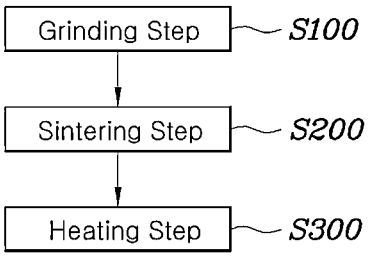
FIG. 1 is an exemplary diagram showing a process of the method for producing the NdFeB permanent magnet according to one exemplary embodiment of the present invention.

It should be understood that the accompanying drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment. In the figures, reference numbers refer to the same or equivalent parts of the present invention throughout the several figures of the drawing.

DETAILED DESCRIPTION

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about".

Hereinafter, the exemplary embodiments of the present invention now will be described in detail with reference to the accompanying drawings. FIG. 1 is an exemplary diagram showing a process of the method for producing the NdFeB permanent magnet according to one exemplary embodiment of the present invention.

In one exemplary embodiment, the NdFeB permanent magnet may contain Nd of about 25 to 30 wt %, Dy of about 0.5 to 6 wt %, Tb of about 0.2 to 2 wt %, Cu of about 0.1 to 0.5 wt %, B of about 0.8 to 2 wt %, a balance of Fe and other inevitable impurities. The sum of the Dy content and Tb content may be about 2 to 7 wt %. Further, the NdFeB permanent magnet may further contain Pr 5 wt % or less.

In another exemplary embodiments of the present invention, the method for producing the NdFeB permanent magnet may include: a grinding step of finely grinding a NdFeB stripcasted alloy consisting of the composition of the NdFeB permanent magnet except Tb, thereby forming the NdFeB stripcasted alloy powder; a preparing step of a Tb powder separately from the composition in the grinding step; a sintering step of sintering the NdFeB stripcasted alloy powder and the Tb powder together; and a heating step for heat treating the sintered powders. In certain exemplary embodiments, the Tb powder may consist of at least one of a metal, alloy or compound containing Tb.

In addition, in the grinding step, the NdFeB stripcasted alloy may be finely ground to the size of about 3 to 6 μm. The sintering step may be conducted at about 1000 to 1100° C. for about 3 to 5 hours. The sintering step may be conducted at the vacuum condition of about $10^{-3}$ to $10^{-2}$ Pa. The heating step may be conducted at the condition of about $10^{-5}$ to $5\times10^{-5}$ Pa and about 850 to 950° C. The heating step may be conducted at the vacuum condition containing a minimal amount of argon (Ar) gas.

In another exemplary embodiment, Tb or the Tb compound/alloy may be placed into a box, separately from the pressed body of the magnet, but may be arranged in the same sealed box made of graphite. Due to the graphite box, pressure of vacuum in the box may be maintained at about half of that in the sintering furnace during the sintering process. For example, when vacuum pressure in a sintering furnace is about $10^{-3}$ Pa, the vacuum pressure in the graphite box may be maintained at about $5\times10^{-2}$ Pa. Thus, evaporation of Tb may be prevented, and then during the heating process after the sintering process, the vapor-deposition of Tb on the magnet may be induced by evaporating at the condition of about $10^{-5}$ Pa and about 850 to 950° C.

The evaporation rate of Tb may be controlled by vapor pressure and heating temperature. For example, when Tb is excessively evaporated (e.g., evaporated beyond a predetermined amount), the evaporation/vapor-deposition rate of Tb may be controlled by injecting an amount of Ar gas and subsequently by controlling the vacuum degree/temperature. The heating temperature may be maintained below the certain temperature to cause Tb diffuse to grain boundary.

Conventional magnets typically contain Dy in an amount of about 9 to 10 wt % in a NdFeB stripcasted alloy to show a coercivity of 30 kOe or greater. In the present invention, the Dy content in the NdFeB stripcasted alloy may be reduced by about 4 to 6 wt %, and the amount of Tb may be diffused along the grain boundary. Therefore, the coercivity may be improved by as much as about 6 to 10 kOe, to achieve the coercivity of about 30 kOe or greater.

Further, the material cost of the magnet may be reduced by reducing the amount of expensive Dy element from 10 wt % to 6 wt %, which may be decreased by about 40%. Meanwhile, Dy element may improve coercivity, and may decrease magnetic force. Therefore, as the amount of Dy used in the NdFeB permanent magnet decreases, the magnetic force may be improved by about 5 to 8%. Chemical compositions of exemplary Embodiments of the present invention and Comparative Examples are shown in Table 1.

TABLE 1

| Sample | | Br (Kg) | iHc (kOe) | Chemical Composition Nd | Pr | Dy | Tb | Cu | B |
|---|---|---|---|---|---|---|---|---|---|
| Comparative Example 1 | M1 | 11.77 | 32.2 | 22 | 0 | 9 | 0 | 0.15 | 1 |
| Comparative Example 2 | M2 | 12.46 | 28.25 | 24 | 0 | 7 | 0 | 0.15 | 1 |
| Comparative Example 3 | D1 | 12.14 | 33.6 | 23 | 0 | 7.8 | 0 | 0.15 | 1 |
| Comparative Example 4 | B1 | 12.84 | 25.10 | 25 | 0 | 5 | 0 | 0.15 | 1 |
| Embodiment 1 | A1 | 12.80 | 35.49 | 25 | 0 | 5 | 0.8 | 0.3 | 1 |
| Comparative Example 5 | M3 | 12.89 | 34.06 | 25 | 0 | 1.3 | 4.2 | 0.15 | 1 |
| Comparative Example 6 | B2 | 13.80 | 18.84 | 27.5 | 0.5 | 1.9 | 0 | 0.15 | 1 |
| Embodiment 2 | A2 | 13.68 | 26.86 | 27.5 | 0.5 | 1.9 | 0.8 | 0.3 | 1 |
| Comparative Example 7 | M4 | 13.27 | 26.46 | 26.5 | 0 | 0 | 4.5 | 0.15 | 1 |
| Comparative Example 5 | M3 | 12.89 | 34.06 | 25 | 0 | 1.3 | 4.2 | 0.15 | 1 |
| Comparative Example 8 | D2 | 12.61 | 33.9 | 25 | 0 | 1.8 | 4.2 | 0.15 | 1 |
| Comparative Example 9 | D3 | 12.73 | 34.02 | 25 | 0 | 1.8 | 4.2 | 0.15 | 1 |
| Comparative Example 10 | D4 | 12.82 | 34.3 | 25 | 0 | 1.8 | 4.2 | 0.15 | 1 |

In one exemplary embodiment, the NdFeB permanent magnet may contain Nd of about 25 to 30 wt %, Dy of about 0.5 to 6 wt %, Tb of about 0.2 to 2 wt %, Cu of about 0.1 to 0.5 wt %, B of about 0.8 to 2 wt %, a balance of Fe and other inevitable impurities. In addition, and the sum of the Dy content and the Tb content may be about 2 to 7 wt %. Further, the NdFeB permanent magnet may further contain Pr of about 5 wt % or less.

Hereinafter, methods for producing Comparative Examples and Embodiments and physical properties thereof will be described.

1) Comparative Examples 1, 2 and 3

In the case of Comparative Examples 1, 2 and 3, the metallic elements of Nd, Dy, Fe and Cu, and Ferroboron of the purity of about 99 wt % or greater were dissolved in a vacuum atmosphere, and then an alloy thin plate having the composition of $Nd_{22}Dy_9B_1Co_{0.5}Cu_{0.15}Al_{0.25}Ga_{0.15}Fe_{bal}$ (wt %) was produced by strip casting method using a roll made of copper. The stripcasted alloy was reacted with hydrogen by exposing to hydrogen gas of 0.11 MPa at room temperature, and then heated to 500° C. while conducting vacuum exhaust, to partly exhaust hydrogen gas. Then the stripcasted alloy was cooled and finely ground to the average powder particle size of about 5 μm in a jet mill using high pressure nitrogen gas. The fine powder was mixed with a lubricant, and then pressed at the pressure of about 1 ton/cm$^3$ while aligning under nitrogen atmosphere in the 3T magnetic field. The pressed body was arranged in a box made of graphite, put into a sintering furnace under a vacuum atmosphere, sintered at 1075° C. for 4 hours, and then heated for 1 hour at 900° C., 700° C. and 500° C., respectively, to form a magnet block. The magnet block was cut into the size of 15×50× thickness 6 mm, ground, and then washed and dried in nitric acid and distilled water. This magnet was called M1 (Comparative Example 1).

With the same method above, a sintered body was produced using an NdFeB stripcasted alloy having the composition of $Nd_{24}Dy_7B_1Co_{0.5}Cu_{0.15}Al_{0.25}Ga_{0.15}Fe_{bal}$ (wt %). After finish the sintering process, a $TbF_3$ powder having average particle size of about 5 μm was mixed and dispersed in isopropyl alcohol, and then coated on the magnet by spraying at the $TbF_3$ powder concentration of 1 wt % followed immediately by drying with a hot air blower. The dried magnet was put into a heat furnace under vacuum condition containing a minimal amount of Ar gas, and then heated at 900° C. for 8 hours followed by heating at 700° C. and 500° C., respectively, for 1 hour. This magnet was called D1 (Comparative Example 3).

Magnet M2 (Comparative Example 2) was also produced by heating by the same method above without coating the $TbF_3$ powder. Br and iHc as magnetic properties of magnets M1, M2 and D1 of Comparative Examples were measured by a BH tracer, and thermal demagnetization was evaluated by flux change measured by a flux meter after heating the magnetized magnet M1 at 200° C. for 2 hours. Chemical composition analysis was conducted by ICP and XRF. For the magnet D1, in which Tb is diffused by the conventional method, iHc was increased by as much as 5.35 kOe and Br was reduced by as much as 0.32 kG, compared to M2. Accordingly, the coercivity may be improved though the diffusion of Tb by the conventional method.

2) Comparative Example 4, Embodiment 1

An NdFeB stripcasted alloy having the composition of $Nd_{25}Dy_5B_1Co_{0.5}Cu_{0.15}$—$Al_{0.25}Ga_{0.15}Fe_{bal}$ (wt %) was produced. The stripcasted alloy was reacted with hydrogen by exposing to hydrogen gas of 0.11 MPa at room temperature, and then heated to 500° C. while conducting vacuum exhaust, to partly exhaust hydrogen gas. Then the stripcasted alloy was cooled and ground to the average powder particle size of about 5 μm in a jet mill using high pressure nitrogen gas. The fine powder was mixed with a lubricant, and then pressed at the pressure of about 1 ton/cm$^3$ while aligning under nitrogen atmosphere in the 3T magnetic field. A Tb—Cu powder having average particle size of about 4 μm was arranged in a space of a box made of graphite, and the pressed body was arranged in the other space. The box was sealed with a lid made of graphite, placed into a sintering furnace, and then sintered at 1075° C. under vacuum condition of $10^{-3}$ Pa for 4 hours. After finishing the sintering process, heating was conducted under vacuum condition of about $1\times10^{-5}$ to $5\times10^{-5}$ Pa at 900 to 950° C. for evaporating the Tb—Cu powder. To control the Tb evaporation rate, a minimal amount of Ar gas was injected thereto and heated for 24 hours while controlling (e.g., adjusting) the temperature and the vacuum degree, followed by heating at 700° C. and 500° C., respectively, for 1 hour. This magnet was called A1 (Embodiment 1).

A magnet was manufactured without inserting Tb—Cu in the graphite box, and was called B1 (Comparative Example 4). The magnetic properties of the magnets B1 and A1 were measured by using a BH tracer and the result thereof were listed in Table 1.

The method of Comparative Example 4 was repeated using an alloy having the composition of $Nd_{25}Dy_{13}B_1Co_{0.5}Cu_{0.15}Al_{0.25}Ga_{0.15}Fe_{bal}$ (wt %) to produce a magnet, and the magnet was called M3 (Comparative Example 5). The magnetic properties and chemical composition were listed in Table 1. When comparing A1 as Embodiment 1 of the present invention with B1 of Comparative Example 4, since the diffusion of Tb, the coercivity was improved by 10.39 kOe, and the remanence magnetic flux density was reduced by as much as 0.04 kG. Thus, there was minimal difference in the current magnetic flux density between A1 and B1.

When comparing M3 (Comparative Example 5) produced by a general NdFeB producing method with A1 of Embodiment, the difference of the remanence magnetic flux density was 0.09 kG, and the difference of coercivity was 1.43 kOe. Accordingly, it could be found that the remanence magnetic flux density and the coercivity were almost the same in both cases, but the amount of the heavy rare-earth used, i.e., Dy, are different. Generally, Tb showed about two times greater coercivity than Dy, but it is about two times more expensive than Dy. When converting the Tb content to the Dy content, M3 of Comparative Example 5 contained heavy rare-earth in about an equal amount to Dy 9.7 wt %, and the A1 of Embodiment 1 contained heavy rare-earth in about an equal amount to Dy 6.6 wt %. Therefore, the cost for A1 may be reduced by as much as 30% in the Dy amount used from the cost for M3.

3) Embodiment 2, Comparative Example 6

A pressed body was produced using an NdFeB stripcasted alloy having the composition of $Nd_{27.5}Pr_{0.5}Dy_{1.9}B_1Co_{0.5}Cu_{0.15}Al_{0.25}Ga_{0.15}Fe_{bal}$ (wt %). A Tb—Cu powder having average particle size of about 4 μm was arranged in a space of a graphite box, and the pressed body was arranged in the other space. The box was sealed with a lid made of graphite, placed into a sintering furnace, and then sintered at 1075° C. under vacuum condition of $10^{-3}$ Pa for 4 hours. After finishing the sintering process, heating was conducted for 10 hours without controlling the Tb evaporation rate under vacuum condition of about $1\times10^{-5}$ to $5\times10^{-5}$ Pa at 900 to 950° C. for evaporating the Tb—Cu powder. After heating for diffusion, heating was conducted at 700° C. and 500° C., respectively, for 1 hour. This magnet was called A2 (Embodiment 2). On the other hand, the magnet, which was produced without adding the Tb—Cu powder, was called B2 (Comparative Example 6).

4) Comparative Example 7

A magnet was produced under the same condition as Comparative Example 6 (B2) with an alloy having the composition of $Nd_{26.5}Tb_{4.5}B_1Co_{0.5}Cu_{0.15}Al_{0.25}Ga_{0.15}Fe_{bal}$ (wt %), and was called M4 (Comparative Example 7). The results of measuring magnetic properties and chemical compositions of magnets B2 (Comparative Example 6), A2 (Embodiment 2) and M4 (Comparative Example 7) were listed in Table 1. For A2 of Embodiment 2 of the present invention, the coercivity was improved by as much as 8.02 kOe, and the remanence magnetic flux density was reduced by as much as 0.12 kG, as compared to B2 (Comparative Example 6). When comparing with M4 (Comparative Example 7), A2 showed about equal coercivity, and greater remanence magnetic flux density as much as 0.41 kG and lower amount of heavy rare-earth used. When converting the Tb content to the Dy content, A2 of Embodiment includes Dy of about 60% less than M4 as Comparative Example.

5) Comparative Examples 8, 9, and 10

A magnet pressed body was produced using an NdFeB stripcated alloy having the composition of $Nd_{25}Dy_{1.3}Tb_{4.2}B_1Co_{0.5}Cu_{0.15}Al_{0.25}Ga_{0.15}Fe_{bal}$ (wt %). A $DyF_3$ powder of 1 wt % was coated on the pressed body. The pressed body was arranged on a graphite plate and then sintered under vacuum condition at 1050° C., 1060° C., and 1070° C., respectively. After sintering, the pressed body was placed into a heat furnace of vacuum condition containing a minimal amount of Ar gas, and heated at 900° C. for 8 hours following the heating at 700° C. and 500° C., respectively, for 1 hour. These were called D2 (Comparative Example 8), D3 (Comparative Example 9) and D4 (Comparative Example 10), respectively.

The results of measuring magnetic properties and chemical compositions of the magnets D2 (Comparative Example 8), D3 (Comparative Example 9) and D4 (Comparative Example 10) were listed in Table 1. The M3 magnet of Comparative Example 5, which used the same alloy but was not coated with the grain boundary diffusion, $DyF_3$, was also compared together. As a result of measurement, in the cases of D2 and D3 as Comparative Examples, sintering and diffusion were conducted at substantially low temperature (e.g., 1050° C. and 1060° C.), and therefore, D2 and D3 showed low remanence magnetic flux density and coercivity due to low sintering temperature. The D4 magnet of Comparative Example via sintering at 1070° C. showed a similar level of magnetic properties to the M3 magnet, and coercivity was about 0.24 kOe greater within the margin of error. As a result of mapping the Dy atoms by EPMA analysis, there was no grain boundary diffusion effect (e.g., minimal effect) since the diffusion into the particles was generated rather than the diffusion to the grain boundary, and the properties were deteriorated due to insufficient sintering by low sintering temperature.

Figure 2:
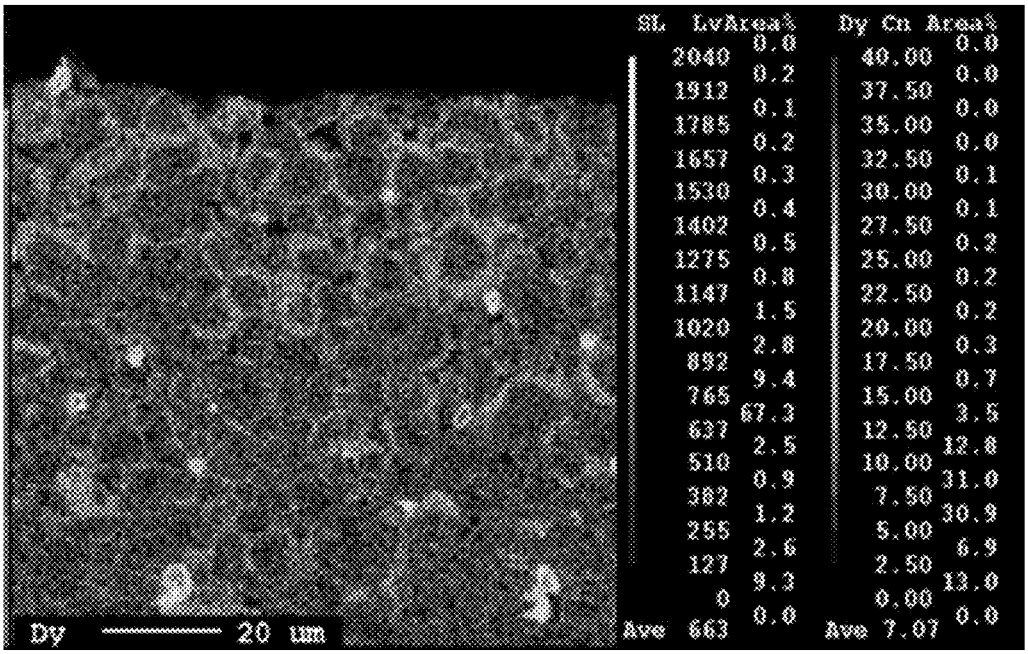
FIGS. 2-11 are exemplary microscopic images showing the results from electron probe micro-analyzer (EPMA) analysis of Comparative Examples and exemplary Embodiments according to the present invention.
Figure 3:
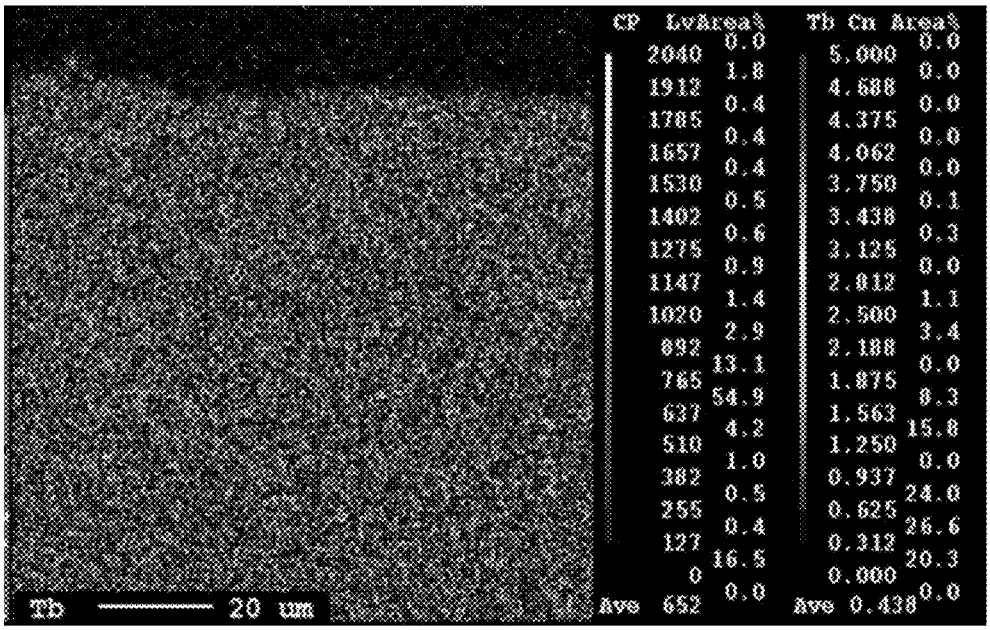
Figure 4:
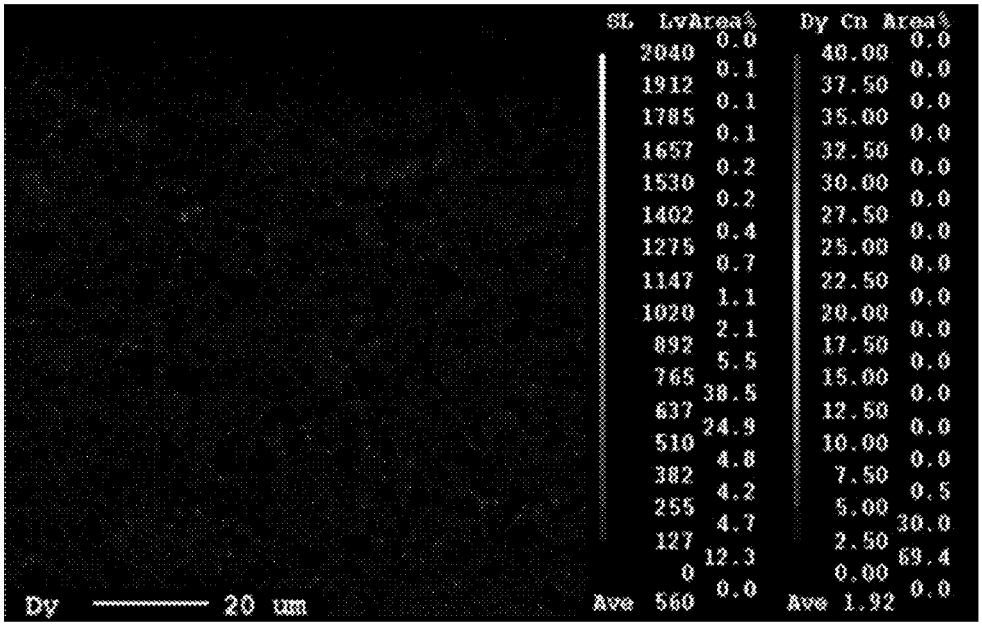
Figure 5:
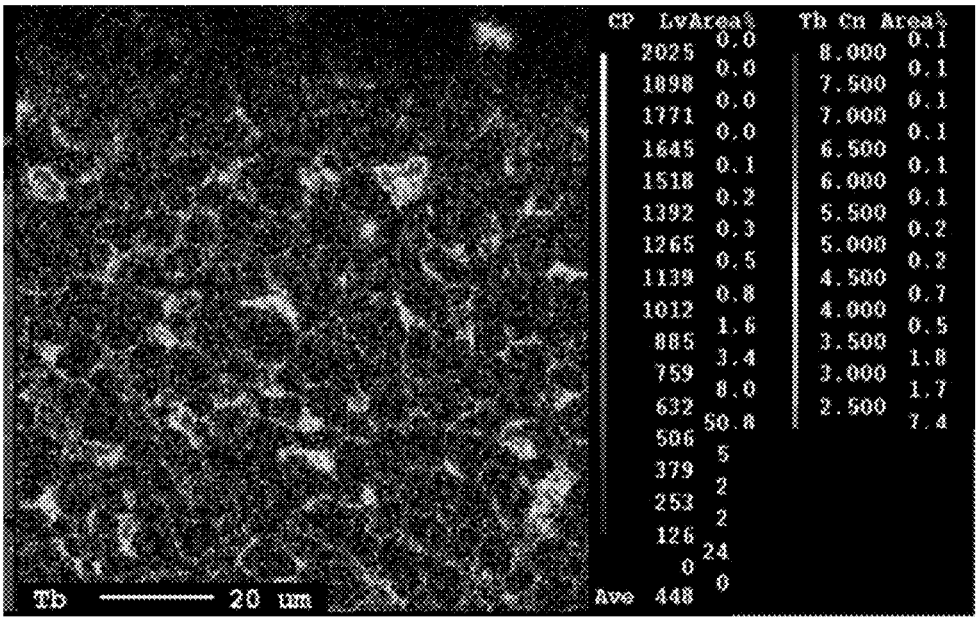
Figure 6:
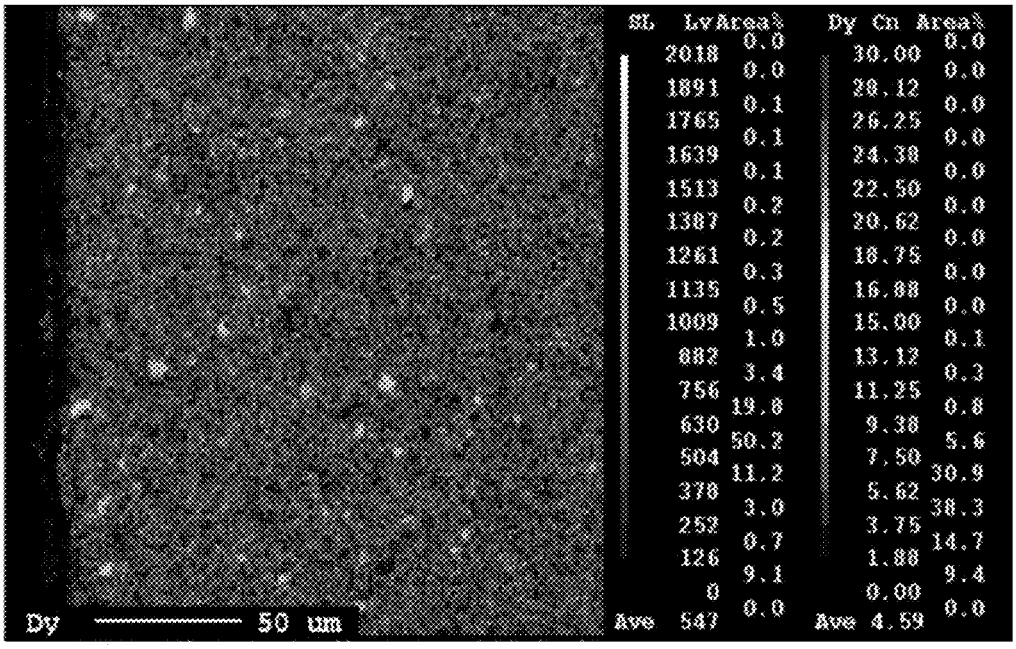
Figure 7:
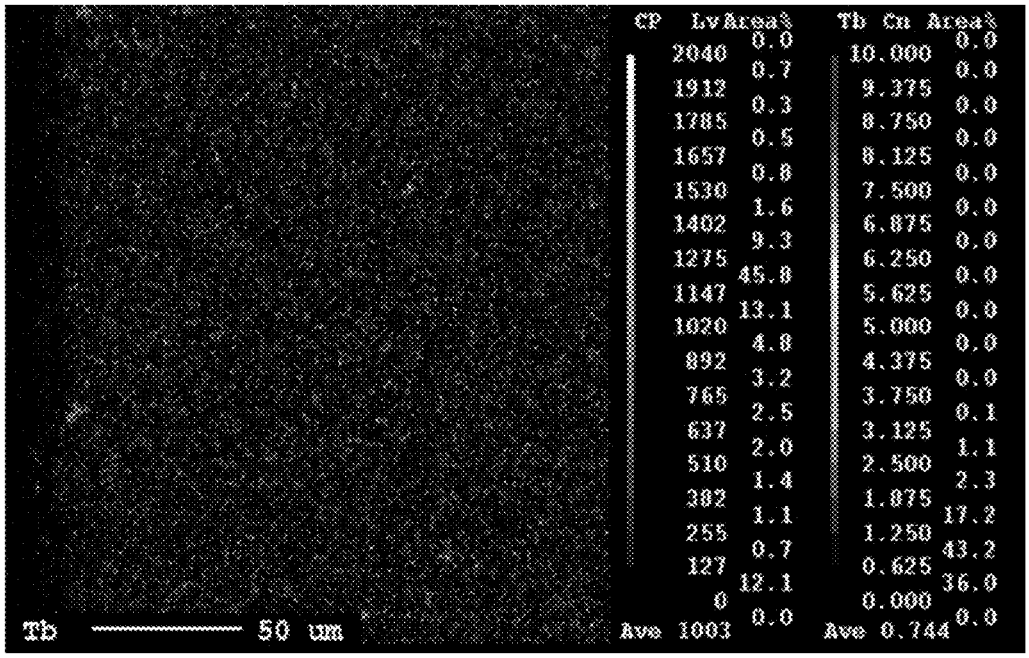
Figure 8:
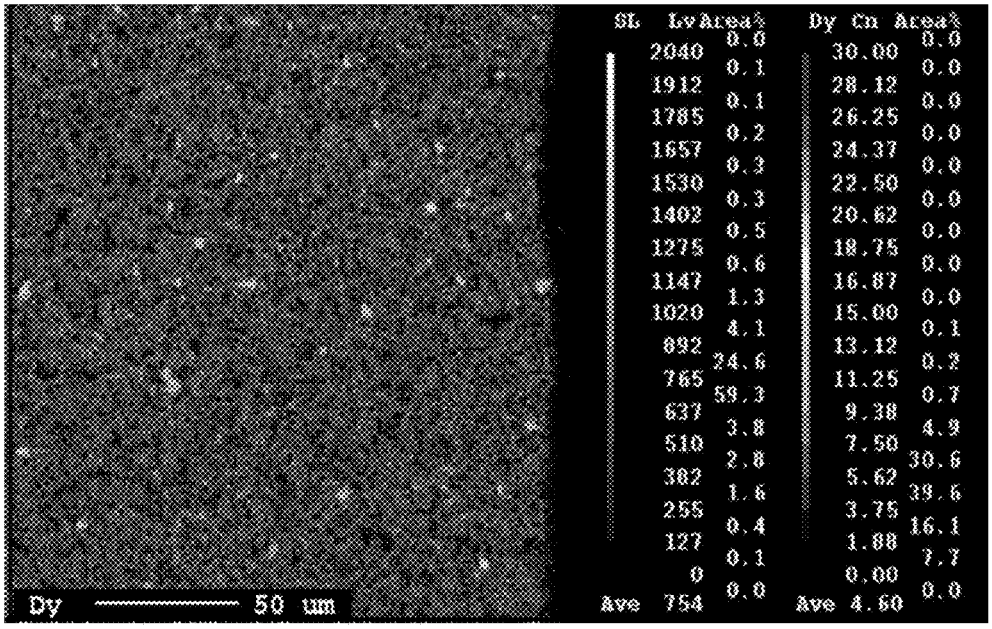
Figure 9:
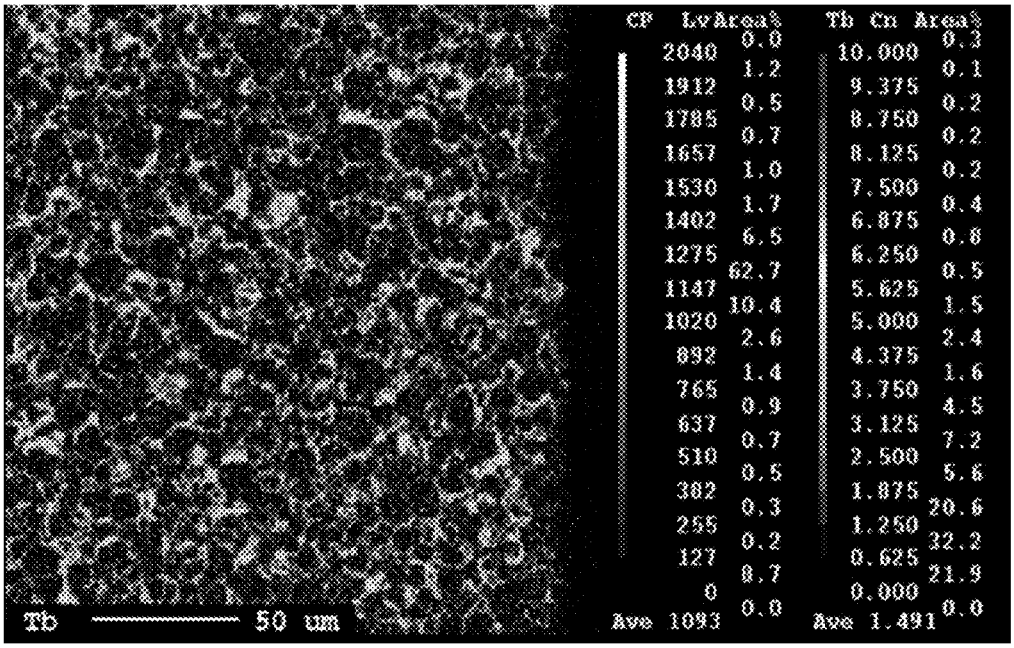
Figure 10:
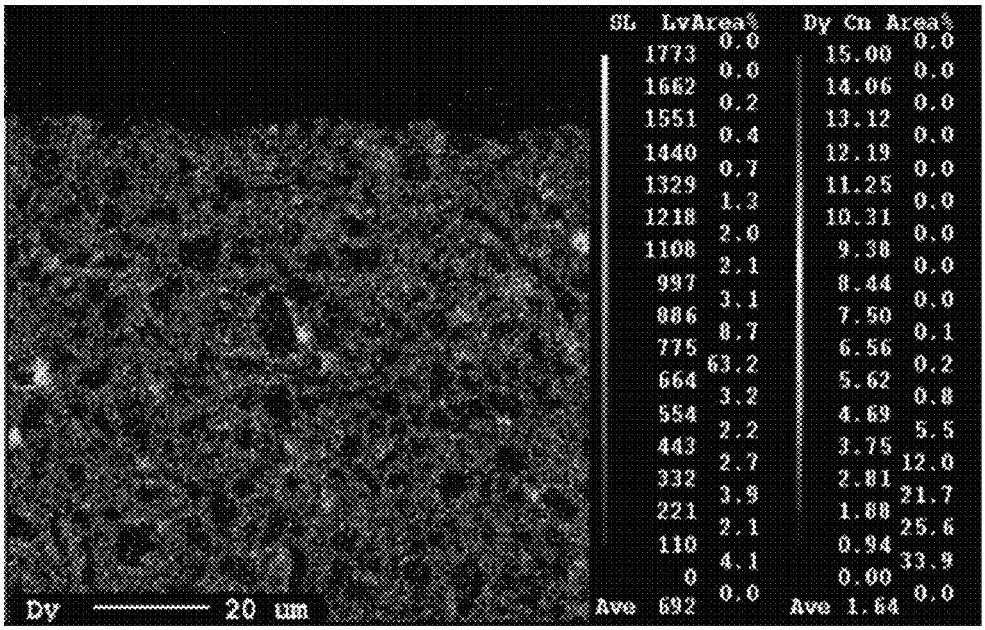
Figure 11:
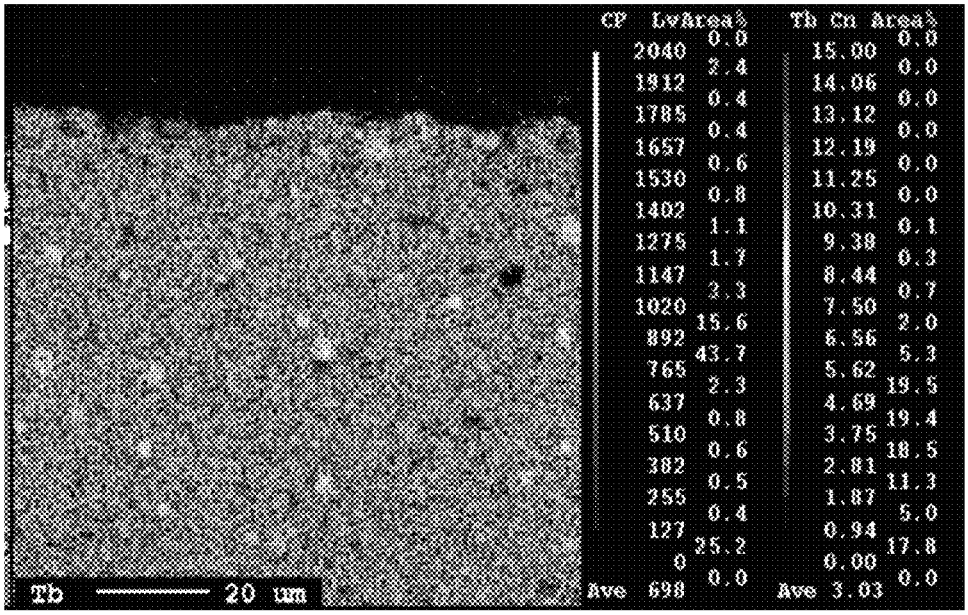

FIGS. 2-11 show the results for the mapping with electron probe micro-analyzer) to observe the distribution shapes of the Dy atoms and the Tb atoms in the each magnet. FIGS. 2 and 3 show the exemplary microscopic images after analyzing the Dy distribution and the Tb distribution of D1 in the Comparative Examples, respectively. In D1 of the Comparative Example, the Dy atoms are distributed more in the grain boundary due to the Dy diffusing (white in FIG. 2). FIGS. 4 and 5 show exemplary microscopic images after analyzing the Dy distribution and the Tb distribution of A2 in the Embodiments, respectively. In A2 of the Embodiments, the Tb atoms are intensively distributed in the grain boundary due to the Tb diffusing (white in FIG. 5). FIGS. 6 and 7 show exemplary microscopic images after analyzing the Dy distribution and the Tb distribution of B1, which is the magnet before the heavy rare earth elements distributed, in the Comparative Examples. In FIGS. 6 and 7, the heavy rare earth elements are not distributed in the grain boundary. FIGS. 8 and 9 show exemplary microscopic images after analyzing the Dy distribution and the Tb distribution of A1 in the Embodiments, respectively. In A1 of the Embodiments, the Tb atoms are intensively distributed in the grain boundary (white in FIG. 9). FIGS. 10 and 11 show exemplary microscopic images after analyzing the Dy distribution and the Tb distribution of M3 in the Comparative Examples, respectively. In M3, in which the content of Tb is increased, of the Comparative Examples, the Tb atoms are uniformly distributed (white in FIG. 11).

As a result of mapping the distribution shape of Dy and Tb in each magnet by EPMA device, D1 as Comparative Example with Dy diffused, the Dy atoms were substantially distributed at the grain boundary. In A2 according to one exemplary embodiment of the present invention with the Tb diffused, the Tb atoms were was also intensively distributed at the grain boundary. According to the NdFeB permanent magnet having the constitution in one exemplary embodiment of the present invention and the method for producing thereof in another exemplary embodiment, a permanent magnet, which costs lower and higher performance than conventional magnets, through reducing the cost of magnet by reducing the amount of expensive Dy element used and through enhancing magnetic force, may be obtained.

The invention has been described in detail with reference to exemplary embodiments thereof. However, it will be appreciated by those skilled in the art that changes or modifications may be made in these embodiments without departing from the principles and spirit of the invention, the scope of which is defined in the appended claims and their equivalents.

What is claimed is:

1. A method for producing the NdFeB permanent magnet comprising:

forming a NdFeB stripcasted alloy which comprises neodymium (Nd) of about 25 to 30 wt %, dysprosium (Dy) of about 0.5 to 6 wt %, copper (Cu) of about 0.1 to 0.5 wt %, boron (B) of about 0.8 to 2 wt %, a balance of iron (Fe) and other inevitable impurities;

finely grinding the NdFeB stripcasted alloy to form a NdFeB stripcasted alloy powder;

preparing a Tb powder separately from the NdFeB stripcasted alloy powder in the grinding step;

sintering the NdFeB stripcasted alloy powder and the Tb powder together in a sintering furnace that has an internal pressure where Tb powder does not evaporate; and heat treating the sintered powders, after adjusting the internal pressure of the sintering furnace so that Tb powder evaporates.

2. The method for producing the NdFeB permanent magnet of claim 1, wherein in the grinding process, the NdFeB stripcasted alloy is ground to a size of about 3 to 6 μm.

3. The method for producing the NdFeB permanent magnet of claim 1, wherein the sintering process is conducted at about 1000 to 1100° C. for about 3 to 5 hours.

4. The method for producing the NdFeB permanent magnet of claim 1, wherein the sintering process is conducted in the vacuum condition of about $10^{-3}$ to $10^{-2}$ Pa.

5. The method for producing the NdFeB permanent magnet of claim 1, wherein the heating process is conducted in the vacuum condition of about $10^{-5}$ to $5\times10^{-5}$ Pa and about 850 to 950° C.

6. The method for producing the NdFeB permanent magnet of claim 1, wherein the sum of the Dy and the Tb is of about 2 to 7 wt % based on weight of the NdFeB permanent magnet.

7. The method for producing the NdFeB permanent magnet of claim 1, wherein the NdFeB magnet further comprises praseodymium (Pr) of about 5 wt % or less not including 0.

* * * * *